United States Patent [19]

Harvey

[11] 4,322,661

[45] Mar. 30, 1982

[54] CROSS-FIELD PLASMA MODE ELECTRIC CONDUCTION CONTROL DEVICE

[75] Inventor: Robin J. Harvey, Thousand Oaks, Calif.

[73] Assignee: Huges Aircraft Company, Culver City, Calif.

[21] Appl. No.: 106,622

[22] Filed: Dec. 26, 1979

[51] Int. Cl.[3] ..... H01J 1/50

[52] U.S. Cl. ..... 315/344; 313/156; 313/161; 315/348

[58] Field of Search ..... 313/157, 161, 199, 200, 313/156; 315/343, 344, 346, 348

[56] References Cited

U.S. PATENT DOCUMENTS

| | | | |
|---|---|---|---|
| 1,617,175 | 2/1927 | Smith | 315/344 |
| 2,039,101 | 4/1936 | McArthur | 315/346 X |
| 2,124,031 | 7/1938 | Freese et al. | 315/344 X |
| 3,405,300 | 10/1968 | Wasa et al. | 315/344 X |
| 4,091,310 | 5/1978 | Harvey | 315/344 |

*Primary Examiner*—Eugene R. La Roche

*Attorney, Agent, or Firm*—Allen A. Dicke, Jr.; W. H. MacAllister

[57] ABSTRACT

Crossed-field plasma mode electric conduction control device 10 has an interelectrode space 16 between anode 12 and cathode 14 in which is produced a magnetic field 38 by coil 28. Electrons produced at region 46 travel through the crossed-fields to region 48, with cascading ionization to produce an electrically conductive plasma. The electrons are lost at region 48 and plasma density is controlled by magnetic field strength to control magnitude of interelectrode current.

7 Claims, 5 Drawing Figures

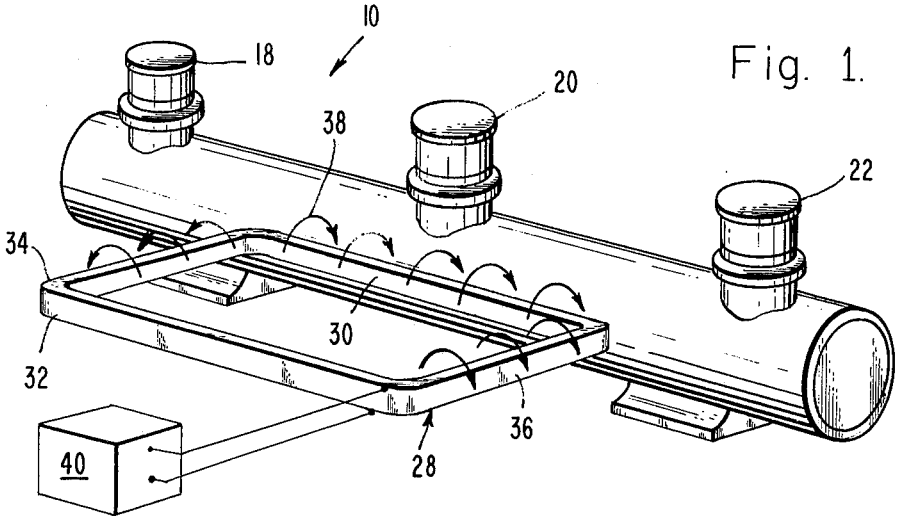
Fig. 1.
Fig. 3.
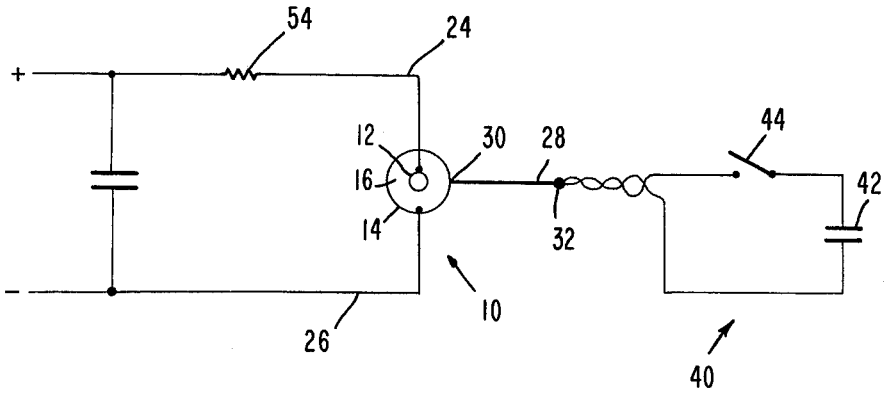

CROSS-FIELD PLASMA MODE ELECTRIC CONDUCTION CONTROL DEVICE

BACKGROUND OF THE INVENTION

This invention is directed to a crossed-field plasma mode electric conduction control device wherein the interelectrode space between a pair of electrodes is subjected to an interelectrode electric field and a magnetic field at right angles thereto. Gas and magnetic conditions are such as to permit interelectrode electric conduction by controlling low pressure glow mode plasma discharge.

Previous crossed-field tubes and other Penning discharge devices have conventionally been constructed with a high degree of symmetry. In a crossed-field switch device for high power off-switching, a uniform distribution of plasma is required in the device. Thus, they have been designed with a magnetic field throughout the entire active interelectrode zone which channels the ionizing electrons around in the ExB direction. When the magnetic field is reduced below a critical level, the energetic electrons are uniformally lost to the anode and plasma generation ceases throughout the interelectrode gap. This results in a bistable operating characteristic with a sharp on-off dependence on the magnetic field.

R. J. Harvey, U.S. Pat. No. 4,071,801 describes a crossed-field switch device having a single interelectrode space or gap, with control of the magnetic field causing off-switching. H. E. Gallagher and Wolfgang Knauer are inventors of U.S. Pat. No. 3,906,270 and U.S. Pat. No. 3,963,960. Both of these are directed to bipolar structures. Gallagher and Knauer, U.S. Pat. No. 3,906,270 describes a single gap crossed-field switch device wherein the magnetic field is shaped to provide for substantially uniform conduction in either polarity. That patent also identifies the early prior art in crossed magnetic and electric field devices, such as those in the Penning U.S. Pat. No. 2,182,736 and Boucher U.S. Pat. Nos. 3,215,893 and 3,215,939. On the other hand, Gallagher and Knauer, U.S. Pat. No. 3,963,960 is directed to a two interelectrode gap device, one having three electrodes, and it identifies in its background the G. A. G. Hofmann et al, U.S. Pat. No. 3,641,384 which has a three electrode structure with two interelectrode spaces.

In addition, Robin J. Harvey, U.S. Pat. No. 4,123,683 describes another configuration of a crossed-field switch device wherein the concentric electrodes are elongated cylinders to provide an interelectrode space which is elongated in the direction of the cylindrical axis, as compared to the other designs. These background patents are incorporated herein in their entirety by this reference. It is seen that they are all directed to bistable equipment and that several of them are particularly useful because of the sharp cutoff during off-switching.

SUMMARY OF THE INVENTION

In order to aid in the understanding of this invention, it can be stated in essentially summary form that it is directed to a crossed-field plasma mode electric conduction control device wherein continuous control of current conduction in the crossed-field switch device is controlled by providing an open ended magnetic trap which can continuously control the density of the conductive plasma to control the rate of current flow.

It is thus an object of this device to provide a crossed-field electric conduction control device wherein the plasma in an interelectrode space is regulated by control of the magnetic field to produce control of the interelectrode current. It is another object to provide a device wherein current flow can be controlled to intermediate values by control of plasma density in an interelectrode space. It is a further object to provide a device for the control of electric current flow.

Other objects and advantages of this invention will become apparent from a study of the following portions of the specification, the claims, and the attached drawings.

BRIEF DESCRIPTION OF THE DRAWINGS

FIG. 1 is a perspective view of a crossed-field plasma mode electric conduction control device in accordance with this invention.

FIG. 3 is an electrical schematic diagram of the circuit in which the control device of this invention is employed.

DETAILED DESCRIPTION OF THE INVENTION

Figure 2:
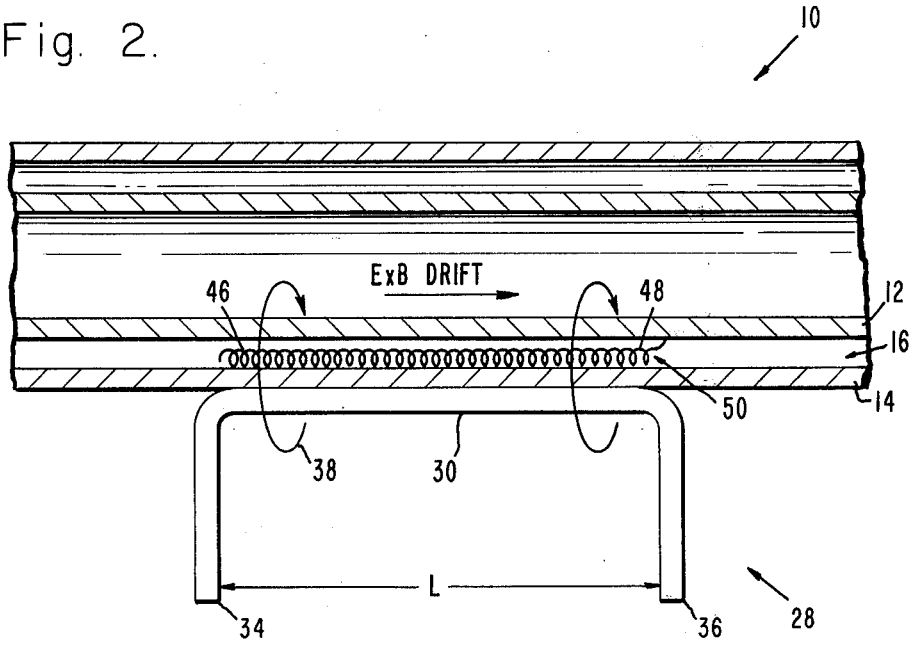
FIG. 2 is a schematic view thereof, with parts broken away.

The crossed-field plasma mode electric conduction control device of this invention is generally indicated at 10 on FIGS. 1, 2 and 3. It comprises an inner anode electrode 12 and an outer cathode electrode 14 which define an interelectrode space or gap 16 therebetween. The outwardly facing surface of the anode or inner electrode 12 and the inner surface of cathode or outer electrode 14 face the interelectrode space 16, and these surfaces serve as the electrically active surfaces which interact with plasma in the interelectrode space 16. Outer electrode 14 serves as an enclosure for the interelectrode space so that a particular gas at a predetermined pressure can be provided in the interelectrode space 16. Furthermore, inner electrode 12 is supported within the outer electrode 14 in a manner that they are electrically separated, for example by insulators in the insulator towers 18, 20 and 22 in the manner shown in Robin J. Harvey, U.S. Pat. No. 4,123,683. Electric connections are provided to both electrodes for connection to lines 24 and 26, see FIG. 3. The lines 24 and 26 allow application of an electric field to the interelectrode space 16.

The magnetic field in the interelectrode space 16 is provided by electromagnet 28 which is in the form of a coil having an active leg 30 adjacent the exterior of outer electrode 14 and aligned with the axis of the electrodes. Electromagnet 28 also has an inactive leg 32 as well as side legs 34 and 36. The side legs and the inactive leg 32 are positioned so as to not provide any substantial magnetic affect in the interelectrode space 16. However, active leg 30 is positioned so that when activated it produces a magnetic field above a critical value in the interelectrode space. The coil of the electromagnet is wound such that the magnetic field is directed at right angles to the electric field as shown by the magnetic field arrows 38 and FIGS. 1 and 2. As is shown on FIGS. 1 and 3, power supply 40, in the form of a current source represented by charged capacitor 42 and switch 44, supplies current to the electromagnetic coil 28 through twisted supply lines to neutralize extraneous field. In that way, an above critical value magnetic field is produced at right angles to the electric field in the interelectrode space 16.

When the gas pressure and gas species are within tolerance, and in the presence of an electric and a magnetic field of suitable magnitude, then the electron bombardment of the gas is sufficient to produce cascading ionization and produce a conductive plasma in the interelectrode space 16. Such a plasma permits electric current conduction between the inner and outer electrodes in a direction depending on polarity of the electric field on the electrodes.

Prior art crossed-field tubes have been off-switching devices with a high degree of symmetry in order to accomplish high power interruptions. When the continuous magnetic field of a crossed-field device of the prior art is broken at some location, energetic electrons channeled by the magnetic field in the direction given by the cross product of the electric and magnetic vector directions are lost to the anode at the end of the magnetic field. In the present device there exists a sufficiently high level of ionization generated by these electrons before they are lost at region 48, so that a self-sustaining plasma is generated and the plasma will penetrate to the upstream end at region 46 of the magnetic electron trap and regenerate new energetic electrons at region 46 by secondary emission processes such as by ion, by excited neutral and by photon bombardment. The efficiency of the regeneration depends on the total electron path length as each electron gyrates as required by the magnetic field, reflects off the cathode fall, and drifts down the channel from region 46 to region 48, where it is lost to the anode. If this path length is long compared to the mean-free length for ionization, the generation of additional plasma can take place as shown at 50 in FIG. 2. Since the electron path length is geometrically related to the length, L, of the field coil 30 between the regions and to the strength, B, of the magnetic field; increasing these quantities increases the ionization efficiency. Likewise, increasing the neutral gas density $\eta$, decreases the mean-free path for ionization for an increase in efficiency.

The open ended character of the magnetic trap relates to the end of the magnetic field intensity as seen by an electron in the interelectrode space. When it runs out of B field it is lost to the anode electrode. When the coil is configured to provide a continuous magnetic field in the interelectrode space the electrons can drift back to where they came from and start over without leaving the high B-field region. The "traps" are traps in the sense that the electrons are confined to near the coil as they drift. When the coil ends somewhere the "trap" is "open" at that location.

FIG. 2 shows that the magnetic field in the gap 16 is strong only underneath the leg 30 of the magnetic field coil. This provides generally for an electron path drifting along the region under the leg 30 where the magnetic field is effective in the interelectrode space. The length of the leg 30 is such as to provide a theoretical electron path length from region 46 to region 48 which is larger than or about one ionization mean free path length in the interelectrode space. There is a sufficient number of ionizing collisions to cause avalanche ionization breakdown and the ionization increases exponentially with the length of the trap, the magnetic field and the gas pressure in the gap.

The interelectrode space in the control device 10 in FIGS. 1 and 2 is filled with a gas at a pressure below the Paschen breakdown limit. When an interelectrode voltage is applied with zero magnetic field in the interelectrode space 16, no conduction can take place. Active leg 30 parallels the outer wall of outer electrode 14 and when a sufficiently high current is produced in that leg, to produce sufficient magnetic field in the interelectrode space, electrons produced at region 46 by cathode emission from outer electrode 14 are temporarily trapped by the curved magnetic field lines, of which line 38 is an example, and the electrons drift in a complicated fashion to near region 48 in the interelectrode space where they are lost to the inner electrode 12 at anode potential. Several such traps can be provided in the same housing and in different areas of the same gap providing the magnetic fields do not interfere in the interelectrode space and the plasma zones do not join.

Figure 4:
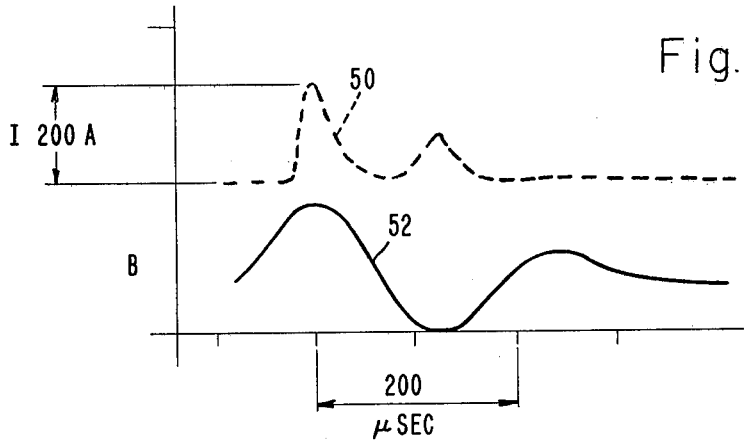
FIG. 4 is a graph showing current versus magnetic field strength in an embodiment of the control device of this invention.

FIG. 3 shows the test circuit which has a precharged capacitor as a power source and a resistor 54 in series with the electrodes to smooth and limit the main electrode current. FIG. 4 shows trace 50 which is the current flowing in the interelectrode space as a function of time. This is compared to the trace 52 which shows the magnetic field strength in the magnetic electron trap in front of active leg 30 in the interelectrode space 16 as a function of time. During the sequence, the interelectrode current in trace 50 varies with the intensity of the magnetic field while the applied capacitor voltage remains essentially constant. The initial increase in current in trace 50 is typically delayed due to the formative and statistical delay times of the plasma. The remainder of the pulse waveform is stable and reproducible.

Figure 5:
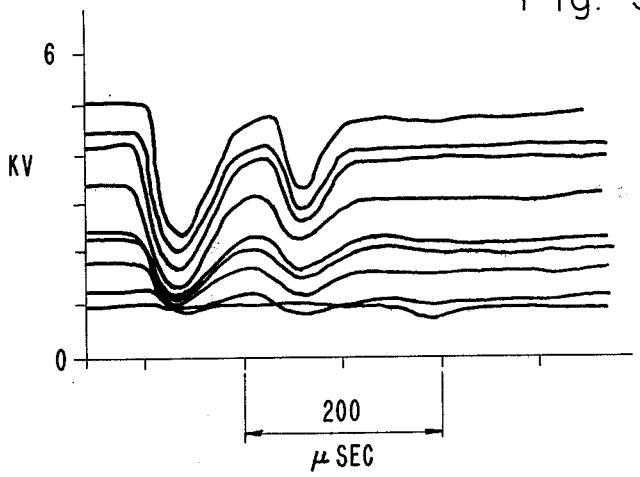
FIG. 5 is a graph showing the interelectrode voltage versus time for various interelectrode starting voltages.

FIG. 5 shows the anode voltage with respect to the cathode voltage, with respect to time, for various initial values of applied voltage before the magnetic field pulse. The voltage applied to the electrodes fall due to current flow through resistor 54, as a function of current flow. In a prior art crossed-field switch device, the voltage would fall to a fixed value, which is the voltage drop through the electrodes and plasma, but in this case the voltage reaches an equilibrium value which is a function of the magnetic fields B, the interelectrode current I and the starting voltage $V_o$. For a fixed value of the magnetic field B, the interelectrode current I has a maximum value at a particular value of starting voltage $V_o$. This equilibrium value $V_m$ roughly increases with the magnetic field B. An approximate expression for the dependence of the interelectrode current I on the other parameters may be written as:

$$I \sim A \exp\left(\frac{L}{L_o} \cdot \left|\frac{B}{B_o}\right| \cdot \frac{\eta}{\eta_o} \cdot a\right)$$

where:

I is interelectrode current,
A is a reaction coefficient,
L is electron path length,
B is magnetic field strength,
a is a constant between 1 and 2
$\eta$ is gas density, and subscript o represents starting conditions.

If additional ionization is present due to another source (i.e., another field coil pulsed at an earlier time), the coefficient A is enhanced by:

$$A \longrightarrow A_o + A_1 \exp\left(\frac{-x}{L_o} - \frac{t}{t_o}\right)$$

where:

x and t are the distance in space and time that the additional souce is displaced and: $t_o \sim 120\ \mu s$.

These experimental results show that the plasma discharge can be controlled in a reproducible fashion to limit current flow through the interelectrode space so that current control at high power is feasible.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A crossed-field electric conduction control device comprising:

first and second spaced electrodes having an interelectrode space therebetween and a means for applying an electric potential between said first and second electrodes for defining an electric field direction between said electrodes;

means for enclosing said interelectrode space for maintaining a selected gas at a selected pressure in the interelectrode space; and means for providing a magnetic field in a region of the interelectrode space at an angle to the electric field therein, said magnetic field being an open path magnetic field within the interelectrode space extending from a first region to a second region which is separate from said first region in said space so that upon the application of electric and magnetic fields, electrons flow on a discontinuous path in the interelectrode space which extends from said first region to said second region and not back to said first region to produce a plasma discharge between the said first region and said second region whereby electric conduction takes place and the plasma density is controlled by regeneration of electrons adjacent said first region, which electrons pass through said interelectrode space causing cascading ionization and the electrons are captured by said second electrode adjacent the second region.

2. The crossed-field device of claim 1 wherein the total electron path length produced by said magnetic field means is about one electron mean free path length.

3. A crossed-field electric conduction control device comprising:

an anode electrode and a cathode electrode spaced from each other to define an interelectrode space, means for enclosing said interelectrode space to permit maintenance of a selected gas under a selected pressure in the interelectrode space and means for applying electric potential to said anode and cathode electrodes to produce an electric field in said interelectrode space;

magnetic field means for producing an open path magnetic field in the interelectrode space at an angle to the electric field therein for producing a magnetic field which extends in the interelectrod space from a first region to a separate second re gion and not back to the first region such that elec trons are produced at the cathode adjacent the firs region and are trapped by the magnetic and electric fields in the interelectrode space to move through the interelectrode space to the second region whereat they are captured by said anode without returning to the first region, said second region being sufficiently spaced from said first region whereby avalanching, cascading ionzation takes place to produce a glow mode plasma electric conduction discharge for controlling current flow between said anode and cathode and so that the plasma density can be controlled to control the amount of current flow between said electrodes.

4. The crossed-field device of claim 3 wherein the current flow between said anode and cathode is controlled by neutral gas density.

5. The crossed-field device of claim 4 wherein the current flow is controlled by magnetic field strength.

6. The crossed-field device of claim 5 wherein the plasma density is controlled by the spacing between said first region and said second region.

7. A crossed-field electric conduction control device comprising:

an anode electrode and a cathode electrode spaced from each other to define an interelectrode space, means for enclosing said interelectrode space to permit maintenance of a selected gas under a selected pressure in the interelectrode space and means for applying electric potential to said anode and cathode electrodes to produce an electric field in said interelectrode space;

magnetic field means for producing an open path magnetic field in the interelectrode space at an angle to the electric field therein for producing a magnetic field which extends from a first region to a separate second region and not back to the first region such that electrons are produced at the cathode adjacent the first region and are trapped by the magnetic and electric fields to move through the interelectrode space to the second region whereat they are captured by said anode without returning to the first region, said second region being sufficiently spaced from said first region whereby avalanching, cascading ionization takes place to produce a low mode plasma electric conduction discharge for controlling current flow between said anode and cathode so that the plasma density can be controlled to control the amount of current flow between said electrodes, said interelectrode current being controlled substantially as $$I \sim A \exp\left(\frac{L}{L_o} \cdot \left|\frac{B}{B_o}\right| \cdot \frac{\eta}{\eta_o} \cdot a\right)$$

wherein:

I is interelectrode current,

A is a reaction coefficient,

L is electron path length,

B is magnetic field strength, a is a constant, $\eta$ is gas density, and subscript o represents starting conditions.

* * * * *